US010471445B2

(12) United States Patent
Fritz et al.

(10) Patent No.: US 10,471,445 B2
(45) Date of Patent: Nov. 12, 2019

(54) COATING MACHINE COMPONENT INCLUDING A FUNCTIONAL ELEMENT THAT IS A COATING

(75) Inventors: Hans-Georg Fritz, Ostfildern (DE); Steffen Wesselky, Adelberg (DE); Timo Beyl, Besigheim (DE)

(73) Assignee: Dürr Systems GmbH, Bietigheim-Bissingen (DE)

( * ) Notice: Subject to any disclaimer, the term of this patent is extended or adjusted under 35 U.S.C. 154(b) by 440 days.

(21) Appl. No.: 13/128,068

(22) PCT Filed: Nov. 2, 2009

(86) PCT No.: PCT/EP2009/007841
§ 371 (c)(1),
(2), (4) Date: Jul. 18, 2011

(87) PCT Pub. No.: WO2010/051958
PCT Pub. Date: May 14, 2010

(65) Prior Publication Data

US 2011/0265717 A1 Nov. 3, 2011

(30) Foreign Application Priority Data

Nov. 7, 2008 (DE) ..... 10 2008 056 411

(51) Int. Cl.
*B05B 3/10* (2006.01)
*B05B 15/18* (2018.01)
(Continued)

(52) U.S. Cl.
CPC ..... *B05B 3/1014* (2013.01); *B05B 5/0407* (2013.01); *B05B 15/18* (2018.02);
(Continued)

(58) Field of Classification Search
CPC ..... B05B 5/0407; B05B 5/0415; B05B 17/00; B05D 1/36; B22F 9/082; B32B 15/04;
(Continued)

(56) References Cited

U.S. PATENT DOCUMENTS 4,148,932 A * 4/1979 Tada ..... B05B 5/0407 239/3
4,376,135 A * 3/1983 Patel ..... B05B 5/0411 118/626
(Continued)

FOREIGN PATENT DOCUMENTS

DE 4413306 C1 10/1995
DE 4439924 A1 5/1996
(Continued)

OTHER PUBLICATIONS

"Titanium Nitride", http://nanopartikel.info/cms/lang/en/Wissensbasis/Titannitrid;jsessionid=4494138ECAE894F96468890B0245259, May 3, 2013, pp. 1-2.*
(Continued)

*Primary Examiner* — Karl Kurple
(74) *Attorney, Agent, or Firm* — Bejin Bieneman PLC

(57) ABSTRACT

A coating machine component, e.g., a bell plate for a rotary atomizer, and corresponding production methods are disclosed. An exemplary coating machine component includes a molded base body and a functional element for providing at least one of mechanical stiffening, chemical and/or electrical functionalizing of the coating machine component. The functional element may be made from a material having a greater mass density than the base body. An exemplary functional element may be a coating that is at least partially applied to the base body.

12 Claims, 3 Drawing Sheets

(51) Int. Cl.
*C23C 28/02* (2006.01)
*B05B 5/04* (2006.01)
*B05D 7/00* (2006.01)

(52) U.S. Cl.
CPC ..... *B05D 7/50* (2013.01); *C23C 28/028* (2013.01); *B05D 2201/02* (2013.01); *Y10T 428/13* (2015.01); *Y10T 428/2495* (2015.01); *Y10T 428/24983* (2015.01); *Y10T 428/24992* (2015.01)

(58) Field of Classification Search
CPC ..... B32B 7/02; B32B 9/00; C23C 28/042; C23C 28/42; Y10S 239/19
USPC .... 118/300, 620, 629; 239/1, 214, 223, 700, 239/703, DIG. 14, DIG. 19; 427/248.1; 428/217, 547
See application file for complete search history.

(56) References Cited

U.S. PATENT DOCUMENTS 4,398,493 A 8/1983 Gillett et al.
4,458,844 A * 7/1984 Mitsui ..... B05B 5/0407 239/222.11
4,784,332 A * 11/1988 Takeuchi et al. ..... 239/703
4,813,606 A * 3/1989 Brusadin ..... B05B 3/0481 239/230
5,249,554 A 10/1993 Tamor et al.
5,397,063 A * 3/1995 Weinstein ..... B05B 3/1064 239/700
5,662,278 A * 9/1997 Howe et al. ..... 239/700
5,803,372 A * 9/1998 Weinstein ..... B05B 3/1064 239/223
5,923,944 A * 7/1999 Coffinberry ..... B01J 19/02 123/668
6,003,785 A * 12/1999 Duey ..... B05B 3/1064 239/223
6,053,428 A * 4/2000 Van Der Steur ..... B05B 3/1014 239/112
6,076,751 A 6/2000 Austin et al.
6,146,714 A * 11/2000 Beyer ..... C23C 14/046 427/230
6,189,804 B1 * 2/2001 Vetter et al. ..... 239/7
6,230,993 B1 * 5/2001 Austin et al. ..... 239/700
6,360,962 B2 * 3/2002 Vetter ..... 239/106
6,409,104 B1 * 6/2002 Fiala et al. ..... 239/223
6,659,367 B2 * 12/2003 Ballu ..... B05B 5/0407 239/223
7,946,298 B1 * 5/2011 Marks ..... B05B 3/1014 134/102.2
8,430,058 B2 * 4/2013 Sakakibara ..... B05B 5/001 118/620
2003/0072878 A1 * 4/2003 Fournes ..... C23C 10/06 427/250
2004/0195395 A1 * 10/2004 McLaughlin ..... 239/589
2005/0194474 A1 * 9/2005 Sakakibara ..... B05B 5/053 239/690
2006/0135282 A1 6/2006 Palumbo et al.
2009/0092753 A1 * 4/2009 Carlin ..... C23C 10/06 427/237
2009/0212122 A1 * 8/2009 Nolte et al. ..... 239/1
2009/0224066 A1 * 9/2009 Riemer ..... A21C 15/002 239/102.2
2009/0255463 A1 * 10/2009 Seitz ..... B05B 3/1064 118/300
2010/0155504 A1 * 6/2010 Yamasaki ..... B05B 3/1014 239/214
2010/0224665 A1 * 9/2010 Vinnay ..... B05B 7/08 226/102
2011/0086166 A1 * 4/2011 Fischer et al. ..... 427/248.1
2011/0174338 A1 * 7/2011 Marks ..... B05B 3/1014 134/22.18
2011/0312159 A1 * 12/2011 Saxler et al. ..... 438/478
2012/0132726 A1 * 5/2012 Seiz ..... B05B 3/1042 239/225.1
2012/0180722 A1 * 7/2012 Nolte ..... B05B 3/1035 118/712
2012/0305681 A1 * 12/2012 Fritz et al. ..... 239/589
2013/0026258 A1 * 1/2013 Motozaki ..... B05B 3/1014 239/700
2013/0040119 A1 * 2/2013 Chen ..... B05D 1/36 428/213

FOREIGN PATENT DOCUMENTS

DE 19645630 A1 5/1998
DE 101 12 854 A1 10/2001
DE 102004032045 A1 1/2006
DE 102006005765 A1 8/2007
DE 102006022057 10/2007
DE 102006022057 B3 * 10/2007 ..... B05B 3/10
DE 202007015115 U1 4/2008
DE 102008047118 A1 4/2010
EP 0283918 A2 9/1988
EP 951942 A2 * 10/1999 ..... B05B 5/04
EP 1317962 A1 6/2003
GB 2399049 A 9/2004
JP S515344 A 1/1976
JP 61035868 2/1986
JP 6316855 2/1988
JP H07328490 A 12/1995
JP 2003080123 A 3/2003
JP 3098958 10/2003
JP 2007531819 11/2007
JP 2009536569 10/2009
WO WO-90/01568 A1 2/1990
WO WO 2005093117 10/2005
WO WO 2007131661 11/2007
WO 2007138619 A1 12/2007
WO WO 2008011642 A2 * 1/2008 ..... C23C 26/00

OTHER PUBLICATIONS

Silaeva, V.I. and Solov' eva, T.V., "Triboengineering Properties of Aluminum Alloys with a Coating of Titanium Nitride", May 1996, UDC, vol. 38, pp. 220-223.*
"Tensile Strength Properties of Aluminum and Stainless Steel" 2007, American Machine Tools Corp. http://www.americanmachinetools.com/tensile_strength.htm, pp. 1-5.*
Roman, O.V. et al. "Determination of Optimum Conditions for the Application of Titanium Nitride Coatings by Deposition from the Gaseous Phase", 1981, Plenum Publishing Corporation, 0039-5735/80/1912, pp. 826-829.*
"Densities of Miscellaneous Solids", http://www.engineeringtoolbox.com/density-solids-d_1265.html, May 2, 2013, pp. 1-7.*
International Search Report, PCT/EP2009/007841, dated May 7, 2010.
Liu Y et al. "Effects of Pretreatment by Ion Implantation and Interlayer on Adhesion Between Aluminum Substrate and Tin Film" Thin Solid Films, Elsevier-Sequoia S.A. Lausanne, CH, vol. 493, No. 1-2, Dec. 12, 2005, pp. 152-159.

* cited by examiner

COATING MACHINE COMPONENT INCLUDING A FUNCTIONAL ELEMENT THAT IS A COATING

CROSS-REFERENCES TO RELATED APPLICATIONS

This application is a National Stage application which claims the benefit of International Application No. PCT/EP2009/007841 filed Nov. 2, 2009, which claims priority based on German Application No. 10 2008 056411.7, filed Nov. 7, 2008, both of which are hereby incorporated by reference in their entirety.

BACKGROUND

The present disclosure relates to a coating machine component, for example, a bell cup for a rotary atomizer and an appropriate production method.

In modern painting plants for coating vehicle body parts, rotary atomizers are primarily used as the paint applications devices which have a rapidly rotating bell cup which sprays and atomizes the paint to be applied due to the centrifugal forces acting on the paint.

One objective for designing such bell cups is to achieve the lowest possible weight in order to reduce the mechanical loading the bell cup exercises on the bearing unit or the compressed air turbine acting as the drive unit due to the very high rotational speed. Furthermore, a lowest possible weight of the bell cup offers advantages to minimize the forces involved in braking and accelerating the bell cup and therefore to reduce the danger of ejection of the bell cup which would represent a very high risk of an accident occurring.

On the other hand the design of the bell cup must achieve an adequate rotational speed strength so the materials used must demonstrate an adequate strength. Therefore conventional bell cups are usually made out of titanium or aluminum in order to achieve an adequate strength for the lowest possible weight.

A so-called combined bell cup is also known, for example, from EP 1 317 962 B1 and DE 20 2007 015 115 U1. Such combined bell cups consist of a material combination made out of a light material with a relatively low strength and a heavy material with a high strength in order to obtain a bell cup with the lowest possible weight and the highest possible strength. Therefore the combined bell cups consist of a number of components made out of various materials, the various components being connected to each other during assembly. However, also such types of combined bell cups still do not achieve a satisfactory compromise between the design goals of achieving the lowest possible weight on the one hand but also the highest possible strength on the other.

Further coatings are known, for example, from DE 44 39 924 A1, US 4 398 493 A, WO 90/01568 A1 and US 5 249 554 A.

For the sake of completeness one should also refer to conventional bell cups which have a friction reducing coating or a wear reducing coating, the coating not, however, having any influence on the weight and mechanical strength of the bell cup. Such bell cups with a wear reducing or a friction reducing coating are known, for example, from DE 101 12 854 A1 and DE 10 2006 022 057 B3.

It is therefore an object of the present disclosure to provide a bell cup which has the lowest possible weight and the highest possible strength. A further object of the invention is to provide a suitable manufacturing process.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1:
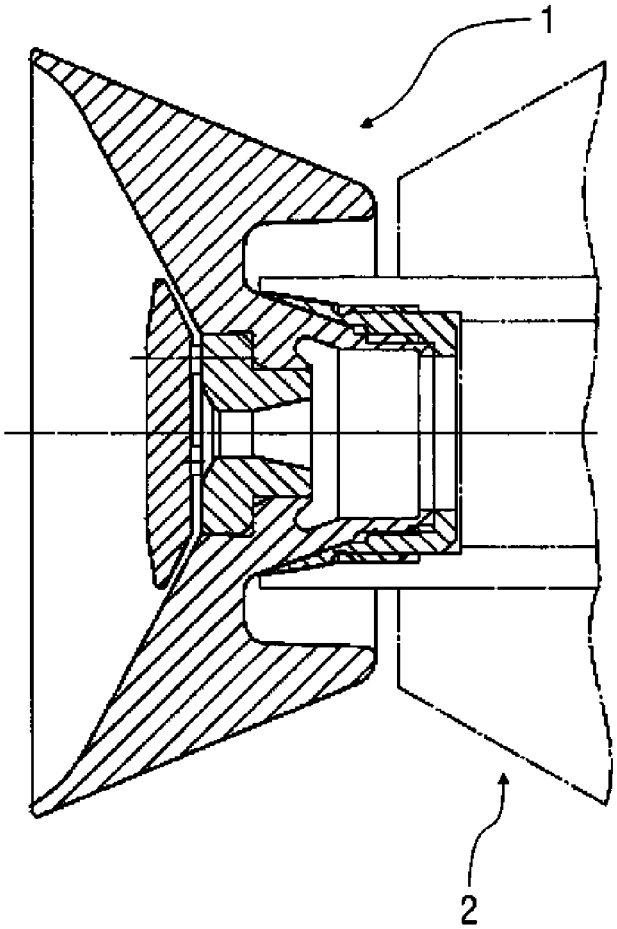
Fig. 1 Prior art
FIG. 1 a cross-sectional view of a conventional bell cup in the condition of being mounted on a rotary atomizer, FIG. 2 a cross-sectional view of a part of a bell cup according to an exemplary illustration with a weight-reducing cavity and a mechanically stiffening coating, FIG. 3 a cross-sectional view of a part of another exemplary bell cup, FIG. 4 a cross-sectional view of a surface area of an exemplary bell cup with a base body and a single-layered coating, FIG. 5 a modification of the exemplary illustration of FIG. 4 with a four-layered coating, FIG. 6 a modification of the exemplary illustration of FIG. 4 with a two-layered coating, FIG. 7 a modification of the exemplary illustration of FIG. 2.

The exemplary illustrations comprise the general technical teaching that the coating machine component (for example a bell cup) has a form shaping base body and a functional element, the functional element serving to achieve mechanical stiffening and/or chemical and/or electrical and/or tribological functionalization of the coating machine component and consists of a material with a higher mass density than that of the form shaping base body. According to the exemplary illustrations, the functional element need not be designed as a separate independent component of the bell cup but instead consists of a coating which is at least partially applied to the base body and which is connected to the base body.

In one exemplary illustration the layered functional element on the base body is a stiffening element which consists of a material with a higher mass density than that of the form shaping base body and a higher strength. Therefore the coating on the base body is configured to, or has the function to, mechanically stiffen the base body and therefore also the finished coating machine component which may be particularly advantageous for a bell cup to increase the rotational speed strength of the bell cup. In this way a fundamental difference is achieved compared to the conventional bell cups mentioned above which have a friction reducing coating or a wear reducing coating, since these conventional coatings do not improve the rigidity of the bell cup, and therefore the rotational speed strength of the bell cup, but simply improve the service life when subjected to abrasive mechanical loads. For the coating machine component (e.g.

the bell cup) according to the invention the mechanically stiffening coating significantly increases the rigidity of the coating machine component so that the rigidity of the coating machine component with the mechanically stiffening coating meets the prescribed requirements whereas the base body on its own without the stiffening coating would not meet the prescribed requirements.

There is, however, also alternatively the possibility that the functional element does not serve for mechanically stiffening the coating machine component but also the electrical functionalization of the coating machine component. For example the coating can consist of a material which has a different electrical conductivity than the material the base body is made of.

There is also the possibility that the layered functional element functionalizes the coating machine component chemically. For example, the coating may include a material which has different chemical properties than the material the form shaping base body is made of.

Furthermore, there is the possibility, as part of the exemplary illustrations, to combine any two or more of the above-mentioned novel variants of mechanical stiffening, electrical functionalization, tribological and chemical functionalization together.

The coating for the base body can, for example, be a metal coating, a ceramic coating, a diamond ceramic coating, a coating containing carbon and/or a nanocrystalline coating, such as the nanocrystalline metal coating offered by the company DuPont under the brand name MetaFuse™. The coating can also consist of organic, inorganic or metallic substances or a mixture thereof.

In one exemplary illustration, the coating has a layer thickness which can lie in the range of a few nanometers up to a number of millimeters. The layer thickness is may therefore be greater than 1 nanometer (nm), 5 nm, 10 nm, 100 nm or even greater than 1 millimeter (mm). Furthermore the layer thickness may be less than 5 mm, 2 mm, 1 mm, 500 nm, 200 nm or even less than 100 nm. However, any layer thicknesses may be employed that are convenient. Accordingly, with regard to the layer thickness of the functionalized coating, the exemplary illustrations are not restricted to the above-stated value ranges, and other layer thicknesses are also feasible.

Furthermore there is the possibility, as part of the exemplary illustrations, that the functionalized coating is made up of a plurality of layers lying one on top of the other with different properties. For example the functionalized coating can include a wear-reducing coating, a rigidity increasing coating, an anti-stick coating and/or a chemically resistant coating. If the functionalized coating contains an anti-stick coating then it may be advantageous that the anti-stick coating has a friction coefficient of less than 0.3, 0.2, 0.1 or even less than 0.05. More specifically, the friction coefficient of the anti-stick coating may lie in the range 0.02-0.3, the friction coefficients being based on a relative measurement in which it is measured against steel in a dry condition.

Furthermore, there is the possibility, as part of the exemplary illustrations, that the coating has a material gradient transverse to the course of the coating layer so that a material property is altered in the coating along the material gradient, that is transverse to the course of the layer. In one example, the material gradient occurs within at least one of the layers so that the material properties alter within the layer concerned. In another example, the material gradient occurs, on the other hand, within the coating over a plurality of layers so that the material properties in the coating can alter over a plurality of layers. For example there is the possibility that the coating and/or the individual layers of the coating become increasingly harder from the inside to the outside.

Furthermore, one should mention the fact that the functionalizing coating may at least in part be applied to the base body. On the one hand the possibility is created, as part of the exemplary illustrations, that the whole surface of the base body is covered by the functionalizing coating. There is, on the other hand, however, the alternative that the functionalizing coating is only applied to part of the surface of the base body.

There is, furthermore, the possibility that the base body has a cavity in order, for example, to reduce the weight of the base body, the functionalizing coating being able to be applied to the inner wall of the base body's cavity.

There is also the possibility, as part of the invention, that the coating is doped with a dopant in order to be able to differentiate an original part from a fake. This is meaningful, amongst other things, since a bell cup typically may be required to meet certain safety requirements. In one exemplary illustration, layers may be treated with a dopant, e.g., as known in semi-conductor technology field. In the process of doping the coating it is possible to dope all original parts in the same way so that it is possible to recognize fakes based on the doping without also requiring differentiation between the individual original parts. There is also the possibility, as part of the invention, that individual coding of the individual original parts takes place as part of the doping process in order, later, to be able to individually identify the individual original parts on the basis of the coding. Coding of the individual coating machine components can, for example, occur in that the doping strength, the doping location and/or the dopant is varied.

From the description above it is already clear that the coating machine component may be a rotating application element being used to apply the coating agent to one of the components to be coated. Examples of such application elements include, but are not limited to, a bell cup, and spraying discs for rotary atomizers.

The term coating machine component used in the description of the exemplary illustrations is not, however, limited to application elements but also includes all components of coating plants such as, merely as examples, color changers, atomizing parts, metering pumps and parts of robots.

The base body and the coating provided for additional stiffening may be designed in such a way that the base body without the coating does not have an adequate rotational speed strength but only in its finished condition with the coating.

Furthermore, it is to be mentioned that the base body may be made out of plastic or a plastic compound material in order to achieve the lowest possible weight of the base body. The exemplary illustrations are, however, not limited to plastic as the material the base body is made of but can also be realized using other possibly usable light materials.

The exemplary illustrations allow realization of a relatively light coating machine component that, together with the base body and the functional element, has an average mass density which can lie in a range of 1 $g/cm^3$ to 5 $g/cm^3$.

Furthermore, exemplary coating machine components may have a certain strength ratio existing between the mechanical strength of the material the functional element is made out of, on the one hand, and the strength of the material the base body is made out of on the other hand, the material the functional element is made out of usually having a significantly greater strength than the material the base body is made out of. The strength ratio concerning the tensile strength may, in one exemplary illustration, be at least 1:4.

Furthermore, exemplary coating machine components (e.g., a bell cup) may have a certain mass density ratio existing between the mass density of the material the functional element is made out of and the mass density of the material the base body is made of, the material the functional element is made out of usually having a significantly higher mass density than the material the base body is made out of. The mass density ratio may be, in one exemplary illustration, in the range 20:1-2:1.

Furthermore, the coating machine components may have a certain thickness ratio existing between the thickness of the material the base body is made out of and the layer thickness of the coating. In one example, the thickness ratio may lie in the range 100.000:1 to 1:1. In another exemplary illustration, the thickness ratio can lie in the range 20:1 to 2:1.

Moreover it is to be mentioned that the exemplary illustrations are not restricted to a single bell cup, but also includes a rotary atomizer with a bell cup, e.g., as further described in exemplary illustrations herein.

Moreover, the exemplary illustrations also may comprise a coating device such as a multi-axis painting robot having a rotary atomizer as the paint application device with the bell cup according to the examples described above.

The exemplary illustrations also may comprise an appropriate manufacturing method for manufacturing a novel coating machine component, the functionalizing coating being applied to the base body as part of the manufacturing method according to the exemplary illustrations.

Various methods can be used in conjunction with the exemplary illustrations, such as painting, dipping, plasma coating, Chemical Vapor Deposition (CVD), Physical Vapor Deposition (PVD), Plasma Assisted Chemical Vapor Deposition (PACVD), current-less metal depositing or galvanization, it being also possible to have any desired combinations of the above-mentioned coating methods.

Moreover, it should also be mentioned that the base body can, for example, be manufactured using a rapid-prototyping method such as that described in U.S. patent application Ser. No. 13/119,064, and/or related International Patent Application No. PCT/EP2009/006674, and/or related German patent application 10 2008 047 118.6, each of which are hereby expressly incorporated by reference in their entireties.

There is, alternatively, also the possibility that the base body is made using an injection-molding method or by means of a material cutting method.

Moreover, the exemplary illustrations allow for use of non-light resistant polymers (such as UV-crosslinked polymers), such as, for example, those used for stereolithographic methods, since these can be completely protected from UV light by the coating.

There is also the possibility of making the base body out of a plurality or mixture of materials. For example, metal parts can be included in the base body, the metal parts being able to be screwed in, for example, or cast in or injected in. It can, therefore, for example, be meaningful that the connection to the turbine consists of a metallic part.

Referring now to the cross-sectional view in FIG. 1, a bell cup 1 is illustrated mounted on a just partially shown rotary atomizer 2. The bell cup 1 may be conventionally made out of titanium or aluminum in order to obtain a highest possible strength and an appropriately high rotational speed strength for the lowest possible weight. In order to minimize the weight, the bell cup 1 also has a cavity 3 which, however, is not shown in FIG. 1.

Figure 2:
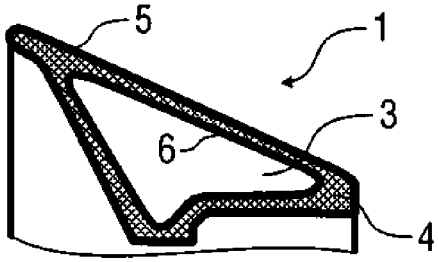

FIG. 2 shows a cross-sectional view of the bell cup 1, according to an exemplary illustration, that partly corresponds to the bell cup 1 described above and is represented in FIG. 1, so that reference will be made to the above description, where the same reference numerals will be used for corresponding details, to avoid repetition.

One special feature of this exemplary bell cup 1 is that the bell cup 1 has a form shaping base body 4 which is made out of plastic and is therefore relatively light. On the other hand, the base body 4 generally has a significantly lower mechanical strength than the bell cup 1 according to FIG. 1 made out of aluminum or titanium.

The base body 4 may therefore be provided with a mechanically stiffening coating 5 in order to reach the required mechanical strength. Furthermore, the inner wall of the cavity 3 is also provided with a mechanically stiffening coating 6 to achieve mechanical stiffening of the bell cup 1.

The coatings 5, 6 include, in this example, a nanocrystalline metal layer with a layer thickness of 500 p.m.

Figure 3:
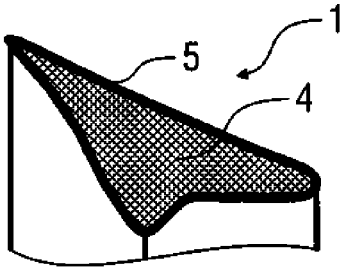

The example as shown in FIG. 3 again corresponds largely with the above-described example embodiment illustrated in FIG. 2, so that reference is made to the above description, the same reference numerals being used for corresponding details, to avoid repetition.

One special feature of this exemplary illustration is that the bell cup 1 does not have a cavity 3 but is provided instead on the outer side with the coating 5.

Figure 4:
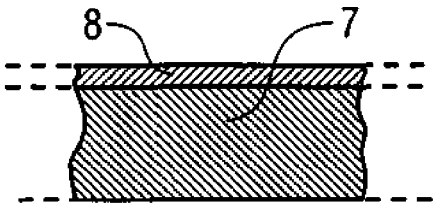

The cross-sectional view in FIG. 4 shows, in a schematic form, a base body 7 of a coating machine component with a single-layered coating 8 on the base body 7 for functionalization of the coating machine component. Coating 8 in this example embodiment may be a nanocrystalline metal layer.

Figure 5:
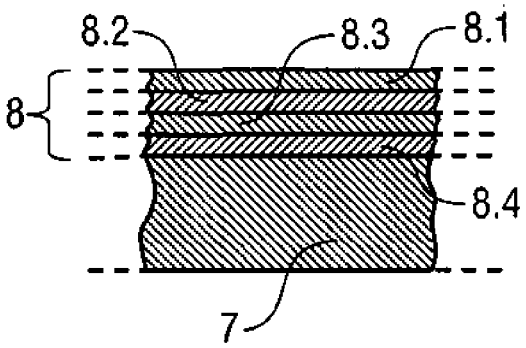

The exemplary illustration as shown in FIG. 5 partially corresponds with the above-described example embodiment illustrated in FIG. 4, so that reference is made to the above description, the same reference numerals being used for corresponding details, to avoid repetition.

One special feature of this example is that the coating 8 is not single-layered but is made up instead of four layers 8.1-8.4 lying one on top of the other. The layers 8.1-8.4 may have various material properties so that a material gradient is formed within the coating 8 from inside to outside. For example, the strength, the hardness and/or the electrical conductivity in the coating 8 can increase from the inside to the outside.

Figure 6:
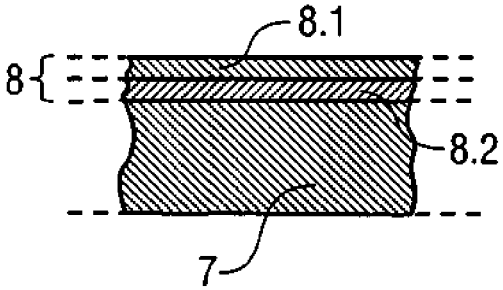

The example illustrated in FIG. 6 in turn mainly corresponds with the above descriptions and the example embodiments represented in FIGS. 4 and 5, so that reference will be made to the above description, the same reference numerals being used for corresponding details, to avoid repetition.

One special feature of this example is that the coating 8 is two-layered and has two layers 8.1, 8.2 lying one on top of the other. The outer layer 8.1 in this example embodiment is an anti-stick or reduced friction layer which can be either electrically conducting or electrically non-conducting. The layer 8.2 lying below, on the other hand, is a nanocrystalline metal layer or another electrically conductive layer.

Figure 7:
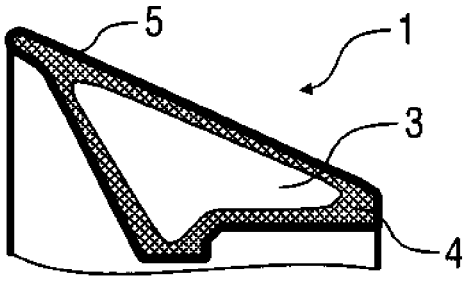

The example as shown in FIG. 7 corresponds largely with the above-described example embodiment illustrated in FIG. 2, so that reference is made to the above description, the same reference numerals being used for corresponding details, to avoid repetition.

A peculiarity of this example is that the inner wall of the cavity 3 is not coated.

The exemplary illustrations are not restricted to the above-described examples. Rather, a large number of variants and modifications are possible, which also make use of the inventive ideas and therefore come under the scope of protection.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

LIST OF REFERENCES

1 Bell cup
2 Rotary atomizer
3 Cavity
4 Base body
5 Coating
6 Coating
7 Base body
8 Coating
8.1-8.4 Layers

The invention claimed is:

1. A rotatable bell cup for atomizing paint comprising: a base body made of plastic, said base body is a form shaping base body, the base body having a thickness, the base body having a plurality of sides, the plurality of sides including an exterior side having an outer surface and a concave recess, and an inner side in a cavity, wherein the cavity is separated from the concave recess by a wall and a functional element configured to provide mechanical stiffening of to increase rigidity of the bell cup, wherein the functional element is made out of a material with a greater mass density than the base body, and wherein the functional element is a coating, having a thickness, that covers the plurality of sides of the base body, and the base body thickness and the coating thickness are in a ratio of 20:1 to 2:1.

2. The rotatable bell cup according to claim 1, wherein the coating is selected from a group consisting of:
a) a metal coating,
b) a ceramic coating,
c) a diamond ceramic coating,
d) a carbon-containing coating, and
e) a nanocrystalline coating.

3. The rotatable bell cup according to claim 1, wherein the coating has a layer thickness,
a) which is greater than 1 nm, and
b) which is less than 5 mm.

4. The rotatable bell cup according to claim 1, wherein
a) the coating has a plurality of layers with one layer lying above another layer with one layer having a material property that is different from a material property of another layer, and
b) the coating has a material gradient so that a material property of the coating changes along the material gradient.

5. The rotatable bell cup according to claim 4, wherein the material gradient occurs in at least one of the layers so that the material property changes within at least one of the layers.

6. The rotatable bell cup according to claim 4, wherein the material gradient occurs in the coating over a plurality of layers so that the material property changes in the coating over a plurality of layers.

7. The rotatable bell cup according to claim 4, wherein the coating and each of the layers of the coating become increasingly harder from inside to outside.

8. The rotatable bell cup according to claim 1, wherein the coating is doped with a dopant.

9. The rotatable bell cup according to claim 1, wherein the rotatable bell cup together with the base body and the functional element has an average mass density, which is
a) greater than 0.5 g/cm3 and
b) smaller than or equal to 10 g/cm3.

10. The rotatable bell cup according to claim 1, wherein:
a predetermined strength ratio exists between the strength of the material of the functional element and the strength of the material of the base body, the strength ratio being greater than 1 and less than 20, and
a predetermined mass density ratio exists between the mass density of the material of the functional element and the mass density of the material of the base body, the mass density ratio being greater than 1 and less than 50.

11. A rotatable bell cup for atomizing paint comprising: a base body formed of plastic; said base body is a form shaping base body, and a coating on the base body, the coating being formed of metal having a greater mass density than the plastic of the base body and having a greater tensile strength than the plastic of the base body wherein the coating increases the rigidity of the bell cup; the base body including a concave recess having a concave surface; the base body including an outer surface extending annularly about the concave surface; and the base body including a wall extending between and separating the concave recess and a cavity; the coating covering the concave surface of the concave recess, and the outer surface of the base body.

12. The rotatable bell cup as set forth in claim 11 wherein the coating includes a plurality of layers, each layer having a hardness, each of the layers one on top of the other, each layer being harder than the next from an outermost layer to an innermost layer.

* * * * *